US007658176B2

(12) United States Patent
Fattorusso et al.

(10) Patent No.: US 7,658,176 B2
(45) Date of Patent: Feb. 9, 2010

(54) STARTER DEVICE

(75) Inventors: Antonio Fattorusso, Leinfelden-Echterdingen (DE); Ulrich Kapinsky, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 12/025,800

(22) Filed: Feb. 5, 2008

(65) Prior Publication Data

US 2008/0196685 A1 Aug. 21, 2008

(30) Foreign Application Priority Data

Feb. 16, 2007 (DE) ..... 10 2007 008 327

(51) Int. Cl.
*F02N 1/00* (2006.01)

(52) U.S. Cl. ..... 123/185.3; 123/185.1

(58) Field of Classification Search ..... 123/179.24, 123/179.28, 185.1, 185.2, 185.3, 185.14
See application file for complete search history.

(56) References Cited

U.S. PATENT DOCUMENTS 5,676,103 A * 10/1997 Tsunoda et al. ..... 123/185.3
6,588,390 B2 7/2003 Kawasaki et al.
6,834,633 B2 * 12/2004 Sing et al. ..... 123/185.3
2003/0100376 A1 * 5/2003 Friedmann et al. ..... 464/68
2004/0079313 A1 * 4/2004 Tsunoda et al. ..... 123/185.3
2004/0250787 A1 * 12/2004 Tohyama ..... 123/185.3
2007/0131190 A1 * 6/2007 Hashiba ..... 123/185.3

* cited by examiner

*Primary Examiner*—Stephen K Cronin
*Assistant Examiner*—Anthony L Bacon
(74) *Attorney, Agent, or Firm*—Gudrun E. Huckett

(57) ABSTRACT

A starter device for an internal combustion engine has a drive element and a output element. The drive element enables driving the starter device in rotation. The output element is supported rotatably about an axis of rotation and has a coupling device for releasably coupling the starter device to the crankshaft. A coil spring is arranged operatively between drive element and output element in an axial direction between a first abutment at the drive element and a second abutment at the output element. The first and second abutments have a first spacing relative to one another at least at one circumferential location in a first area and a second spacing relative to one another in a second area. The first and second spacing are measured parallel to the axis of rotation. The first spacing is smaller than the second spacing. The first area is radially outside of the second area.

17 Claims, 4 Drawing Sheets

STARTER DEVICE

BACKGROUND OF THE INVENTION

The invention relates to a starter device for an internal combustion engine wherein the starter device has a drive element and an output element. The drive element comprises a device for rotatingly driving the starter device. The output element is supported rotatably about an axis of rotation and has means for releasably connecting it to a crankshaft of the internal combustion engine. A coil spring is arranged between the drive element and the output element in operative connection; in the axial direction, it is positioned between an abutment on the drive element and an abutment on the output element.

U.S. Pat. No. 6,588,390 B2 discloses a starter device comprising a drive element and an output element between which a coil spring is arranged. In addition, a pressure spring is provided that forces the coil spring against the cable drum constituting the drive element. In this way, it is prevented that the coil spring during operation can move between the cable drum and the drive element. The pressure spring represents an additional part so that the number of required individual parts is increased, this leading also to greater weight.

SUMMARY OF THE INVENTION

It is an object of the present invention to provide a starter device of the aforementioned kind that has a simple configuration.

In accordance with the present invention, this is achieved in that the abutments at least at one location of the circumference in a first area of the abutments have a first spacing, measured parallel to the axis of rotation, that is smaller than a second spacing of the abutments in a second area, measured parallel to the axis of rotation, wherein the first area is located outside of the second area in a radial direction.

When actuating the starter device the drive element is rotated relative to the output element. In this way, the ends of the coil spring are rotated or turned relative to one another. This rotation of the ends of the coil spring relative to one another effects a change in diameter of the coil spring. The change in diameter effects at the same time a change of the axial length of the coil spring. A reduction of the diameter effects an elongation of the coil spring in the axial direction and an enlargement of the diameter causes shortening in the axial direction. In order to compensate this length change, it is provided that the abutments, against which the two ends of the coil spring rest or adjacent to which the two ends of the coil spring are positioned, are to be arranged in a radial outer area at a different spacing to one another than in a radial inner area. It is not required that the two areas are a peripheral area of the abutments. The spacing in the radial outer area is smaller than the spacing in the radial inner area. Such different spacing must be provided at least at one location of the circumference so that at this location it is possible to provide a securing action of the axial position of the coil spring or a limitation of the axial play of the coil spring. The spacings match advantageously approximately the length of the coil spring in the relaxed state and in the tensioned state.

The drive element and the output element each can be an integral component but it can also be provided that the drive element and/or the output element are of a multi-part configuration.

The starter device is in particular designed for an internal combustion engine of a hand-held power tool such as a motor chainsaw a cut-off machine, a trimmer or the like. For such hand-held power tools the size as well as the weight are decisive factors so that the starter device for a hand-held power toot should have as few parts as possible and should be of minimal size. This is achieved by the starter device according to the invention.

The coil spring must not be directly connected to the drive element and the output element; it is only required that it is positioned between the two elements in operative connection.

Advantageously, the difference of the spacings is more than half of a winding height of the coil spring. In particular, the difference of the spacings matches approximately a winding height of the coil spring. The winding height corresponds to the distance of an exterior edge of a first winding to the corresponding exterior edge of an adjacent second winding. The winding height thus corresponds to the pitch.

For starting the internal combustion engine of a hand-held power tool starter devices are provided in particular where the drive element and the output element can be turned by more than half a revolution, in particular, by approximately one revolution relative to one another. This rotation corresponds to a change of the axial length of the coil spring by more than one half winding height, in particular approximately one winding height. A deviating change of the axial length can result when upon turning of the drive element and output element relative to one another also the spacings between the windings of the coil spring are changed. By changing the spacings of the windings relative to one another, an additional compensation of the change of the number of windings and of the resulting length change of the coil spring can be provided.

A simple configuration of the starter device results when at least one of the abutments is conical. The cone shape must not be configured as a complete continuous surface but can also have disruptions. Advantageously, the abutment at the output element is slanted in the radial direction relative to the axis of rotation while the abutment at the drive element extends plane or flat in the radial direction relative to the axis of rotation. In order to provide excellent guiding of the coil spring, it is provided that at least one abutment is coil-shaped in the circumferential direction. The pitch of this coil shape corresponds in particular to the pitch of the coil spring. In this way, the winding of the coil spring resting against the abutment is supported across its entire length and does not rest only at one point on the abutment. In this way, an excellent support of the coil spring is provided.

Expediently, at least one abutment is formed by abutment webs extending in the radial direction relative to the axis of rotation. This provides for a simple configuration. Friction is reduced because no large surface area contact is provided. The configuration of the abutment in the form of individual webs effects moreover a reduced weight because the parts must not be solid.

Advantageously, the drive element is a cable drum and the device for rotatingly driving is a cable that is wound onto the cable drum and has a starter handle. In this way, the starter device can be actuated manually in a simple way. Expediently, on the cable drum a restoring spring is arranged which effects automatic winding of the pulled starter cable. The coil spring is in particular secured with its drive element end on the cable drum. In this way, a simple configuration of the starter device is provided. The cable drum is coupled by means of the coil spring directly to the output element.

It is provided that the starter device has a guide for the coil spring that is arranged at the inner circumference of the coil spring. The guide is advantageously provided in the form of several guide webs that extend parallel to the axis of rotation. A guiding action for the coil spring across its entire inner circumference is not required. In that the guide is formed by individual guide webs, a simplified configuration is provided. The guide webs can be arranged in a star shape or can project from a cylindrical hub part radially outwardly. In this connection, the guide webs can project outwardly only slightly past the hub part. Other configurations of the guide webs can also be advantageous. Expediently, the drive element as well as the output element have guide webs. This provides an excellent guiding action for the coil spring that is guided in particular across its entire length on its inner circumference.

Advantageously, the output element comprises a follower on which the abutment of the output element is provided. Expediently, the coupling means is a safety catch that comprises at least one pawl that in the coupled state cooperates with at least one locking recess. The pawl is in particular arranged on the follower. The locking recesses in this case are advantageously arranged on a component that is connected to the crankshaft of the internal combustion engine.

In order to achieve a minimal size of the starter device, it is provided that the coil spring has a rectangular wire cross-section. By means of the rectangular wire-cross-section, the space that is available can be utilized well. The section modulus of a coil spring with rectangular wire cross-section is higher in comparison to a coil spring with a round wire cross-section so that a coil spring with rectangular wire cross-section that has the same spring constant as a coil spring with round wire cross-section is smaller than the coil spring with round wire cross-section.

DESCRIPTION OF THE PREFERRED EMBODIMENTS

Figure 1:
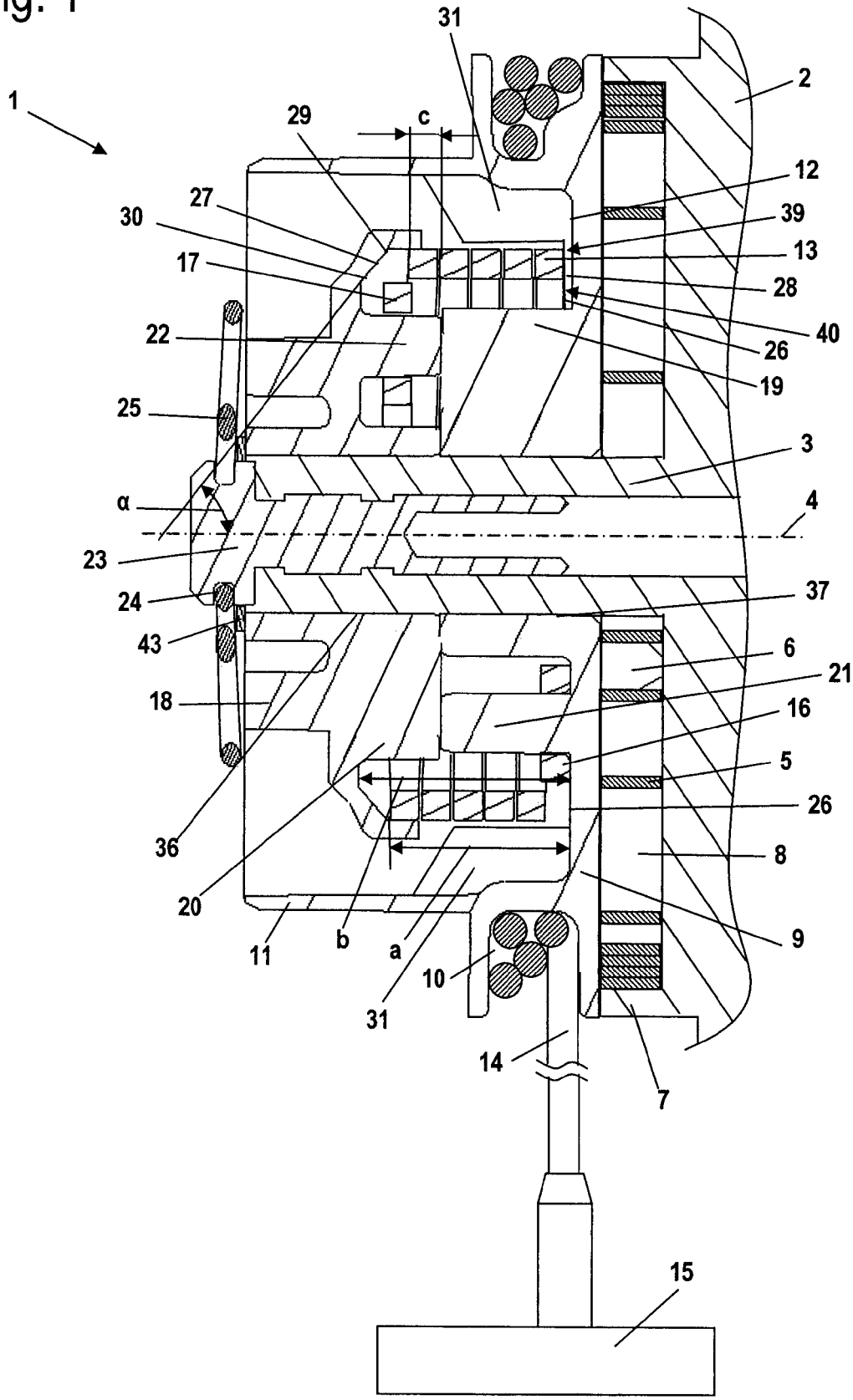
FIG. 1 is a longitudinal section of a starter device according to the invention.

The starter device 1 shown in FIG. 1 is arranged in a housing 2 of a hand-held power tool such as a motor chainsaw, a cut-off machine, a trimmer or the like and serves for starting the internal combustion engine of the hand-held power tool. The starter device 1 has a bearing shaft 3 provided on the housing 2 and configured as an integral part of the housing 2. The bearing shaft 3 can also be embodied as a separate part secured on the housing 2, for example, it can be embedded by injection molding in a housing 2 made from plastic material. The housing 2 has a rim 7 that delimits a receptacle 8. In the receptacle 8 a restoring spring 5 configured as a spiral spring is arranged. The receptacle 8 is closed off by a cable drum 9. A pin 6 is integrally formed on the cable drum 9 and projects into the receptacle 8. One end of the restoring spring 5 is secured to the pin 6. The other end of the restoring spring 5 is secured on the housing 2.

The cable drum 9 is rotatably supported by means of a hub 37 on the bearing shaft 3 for rotation about axis of rotation 4. On its outer circumference the cable drum 9 has a receiving groove 10 and a starter cable 14 is wound into the groove 10. A starter handle 15 is secured to the starter cable 14 and projects from the housing 2 of the power tool so that it can be gripped by the operator. When the starter handle 15 is pulled, the starter cable 14 is unwound from the cable drum and in this way a rotating drive action of the cable drum 9 about axis of rotation 4 is triggered.

Radially inwardly relative to the receiving groove 10 the cable drum 9 has a recess 12 in which a coil spring 13 is arranged. A cylindrical rim 11 projects from the cable drum 9 on a side facing away from the restoring spring 5. The recess 12 and the rim 11 define a receiving space in which the coil spring 13 is arranged. Moreover, in the receiving space a follower 18 is arranged. It is also possible to arrange the follower 18 outside of the receiving space. The follower 18 is rotatably supported by means of hub 36 on the bearing shaft 3 so as to rotate about axis of rotation 4. In the axial direction the follower 18 is secured on the bearing shaft 3 by a securing bracket 25. The securing bracket 25 secures the follower 18 by means of disk 43 that is arranged between the securing bracket 25 and the follower 18. The securing bracket 25 is arranged in a circumferentially extending groove 24 of a securing bolt 23 secured in the bearing shaft 3. The securing bolt 23 can be e.g. press-fit in the bearing shaft 3 or screwed into it.

Figure 4:
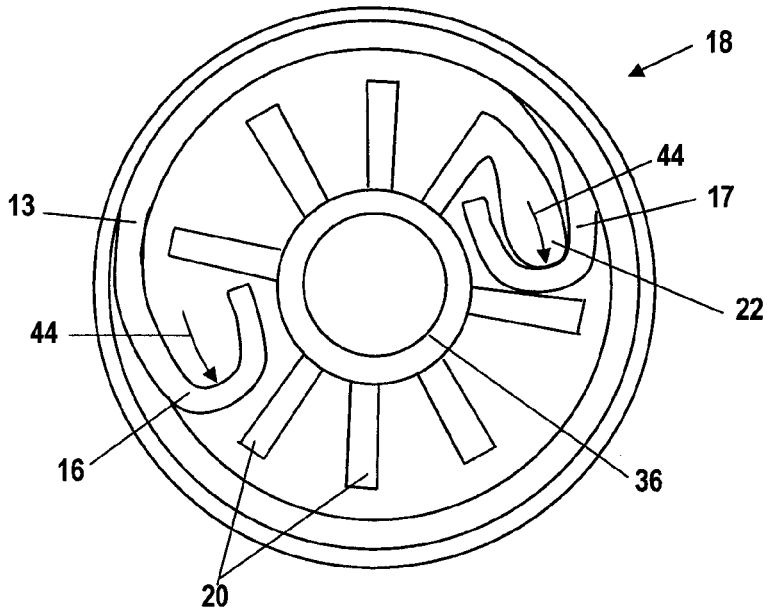
FIG. 4 is a plan view onto the follower of the starter device of FIG. 2 with coil spring arranged thereat viewed in the direction indicated by arrow IV.
Figure 5:
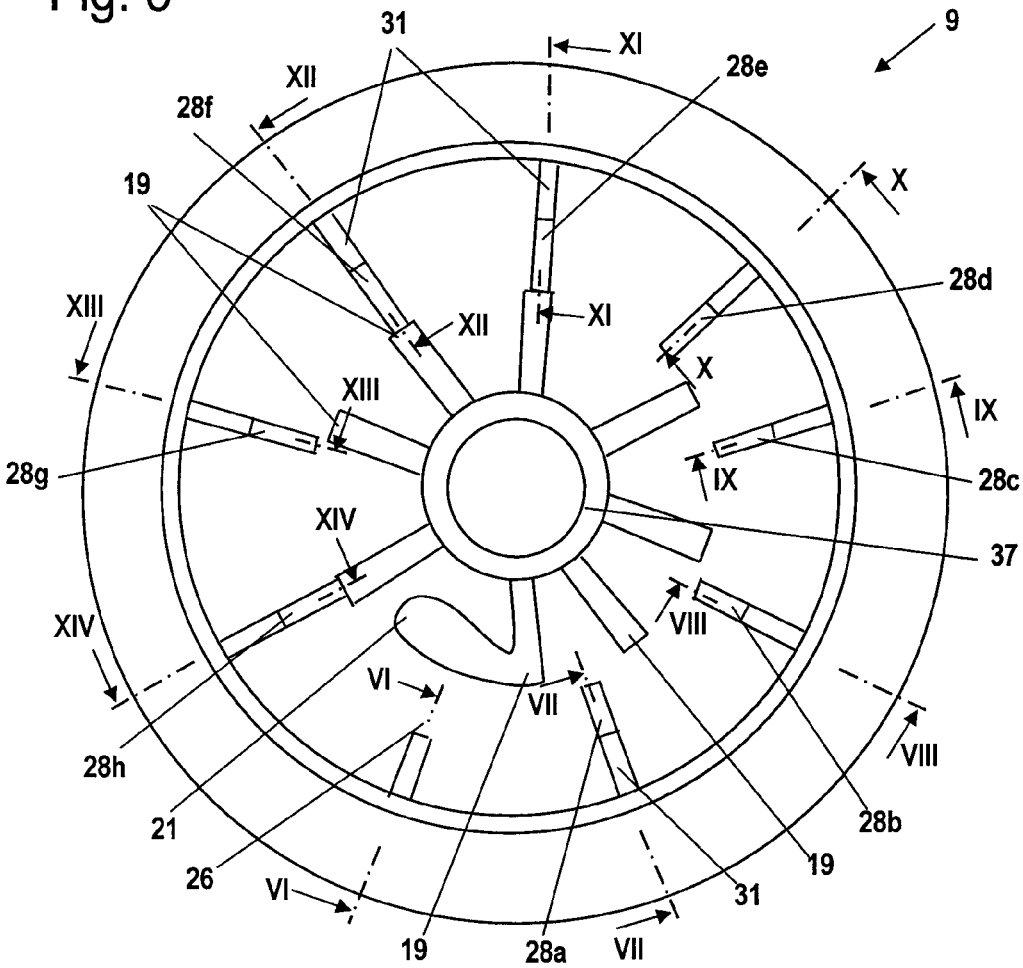
FIG. 5 is a plan view onto the cable drum of the starter device viewed in the direction of arrow V of FIG. 2.

The coil spring 13 is secured with its first end 16 on a holder 21 of the cable drum 9 and with its second end 17 on a holder 22 of the follower 18. The coil spring 13 transmits thus a rotational movement of the cable drum 9 onto the follower 18. On its inner circumference the coil spring 13 is guided by guide webs 19 on the cable drum 9 and guide webs 20 on the follower 18. The guide webs 19 and 20 are shown in FIGS. 4 and 5. As shown in FIG. 4, the guide webs 20 are distributed on the follower 18 in a non-uniform pattern about the circumference. The guide webs 20 extend from the hub 36 radially outwardly. In order to increase the strength of the guide webs 20, it is proposed that the guide webs extend from a circumferential ring radially outwardly and the guide webs 20 are configured only as short radial projections. As shown in FIG. 4, the ends 16 and 17 of the coil spring 13 are configured as inwardly bent hooks. The second end 17 shown in FIG. 4 engages the holder 22 and is hooked on the holder 22. Accordingly, the first end 16 is secured on the holder 21 shown in FIG. 5. Upon rotation of the cable drum 9 relative to the follower 18 the ends 16 and 17 are loaded in the direction of the arrows 44. This causes a reduction of the diameter of the coil spring 13.

The outer circumference of the coil spring 13 is arranged inside receiving webs 31 shown in FIG. 1 and in FIG. 5. The receiving webs 31 have in the radial direction a spacing relative to the coil spring 13 so that the coil spring 13 cannot rest against the receiving webs 31. The receiving webs 31 increase the stability of the cable drum 9.

Figure 6:
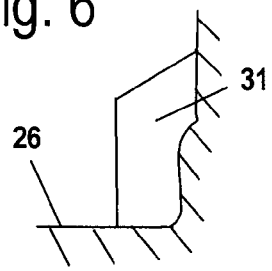
FIG. 6 is a first schematic detail view in section of the starter device of FIG. 5 as indicated by section line VI-VI.
Figure 7:
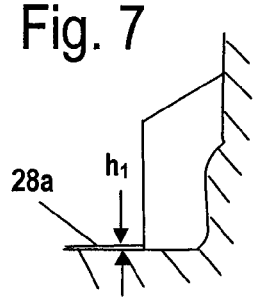
FIG. 7 is a second schematic detail view in section of the starter device of FIG. 5 as indicated by section line VII-VII.
Figure 8:
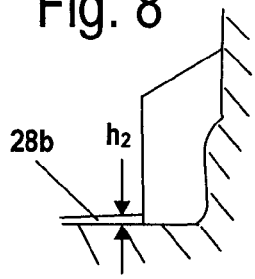
FIG. 8 is a third schematic detail view in section of the starter device of FIG. 5 as indicated by section line VIII-VIII.
Figure 9:
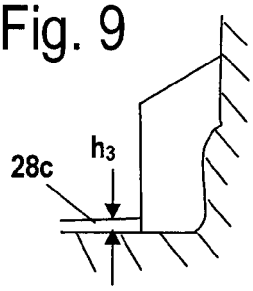
FIG. 9 is a fourth schematic detail view in section of the starter device of FIG. 5 as indicated by section line IX-IX.
Figure 10:
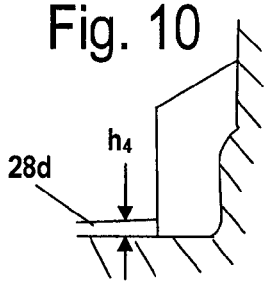
FIG. 10 is a fifth schematic detail view in section of the starter device of FIG. 5 as indicated by section line X-X.
Figure 11:
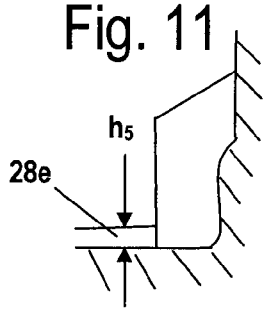
FIG. 11 is a sixth schematic detail view in section of the starter device of FIG. 5 as indicated by section line XI-XI.
Figure 12:
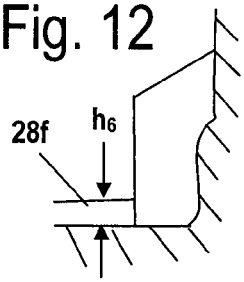
FIG. 12 is a seventh schematic detail view in section of the starter device of FIG. 5 as indicated by section line XII-XII.
Figure 13:
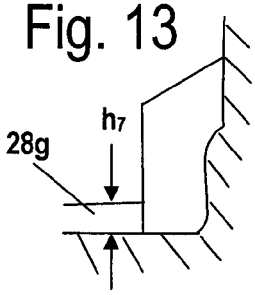
FIG. 13 is a eighth schematic detail view in section of the starter device of FIG. 5 as indicated by section line XIII-XIII.
Figure 14:
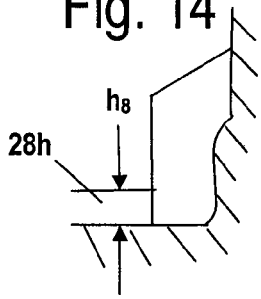
FIG. 14 is a ninth schematic detail view in section of the starter device of FIG. 5 as indicated by section line XIV-XIV.

As shown in FIG. 1, the coil spring 13 rests with its end facing the cable drum 9 against an abutment 26. In the area of the first end 16 the abutment 26 is formed by the wall of the cable drum 9. The abutment 26 extends across a winding of the coil spring 13 in a coil shape. The coil shape is provided by abutment webs 28 that have different axial heights. This is shown in FIG. 5 in connection with FIGS. 6 to 14. As shown in FIG. 5, outside of the holder 21 in the radial direction no abutment web 28 is arranged. This is also shown in FIG. 6. In the illustration of FIG. 5, a total of eight abutment webs 28*a* to 28*h* are arranged counterclockwise at uniform radial spacing. As shown in FIGS. 7 through 14 the height h of the abutment webs 28*a* to 28*h* increases continuously. The difference between two sequentially arranged abutment webs 28 is always the same. The height $h_1$ corresponds to the difference between the height $h_2$ of the abutment web 28*b* to the height $h_1$ of the abutment web 28*a*; the difference of the height $h_3$ of the abutment web 28*c* to the height $h_2$ of the abutment web 28*b* also corresponds to the height $h_1$ etc. The pitch of the coil that is defined by the abutment webs 28*a* to 28*h* is 9 times the height $h_1$ because the circumference is divided by the abutment webs 28*a* to 28*h* and the abutment 26 in the area of the holder 21 into nine identical circumferential sections. The pitch of the coil corresponds thus advantageously to the winding height c of the coil spring illustrated in FIG. 1. The winding height c corresponds to the pitch, i.e., to the axial travel that the coil spring travels for one winding. The winding height c is illustrated in FIG. 1 as a spacing of an outer edge of the winding to the corresponding outer edge of the subsequent winding.

The coil spring 13 rests against the abutment 27 of the follower 18 (the output element). Since the coil spring 13 in the area of its second end 17 is bent inwardly, FIG. 1 shows only in the bottom part of the illustration the contact of the coil spring 13 on the abutment 27. The abutment 27 is conical. In the relaxed position of the starter device 1 illustrated in FIG. 1, the coil spring 13 rests against the abutment 27 in a radial outer area 29 of the abutment 27. This radial outer area 29 has an axial spacing a relative to a radial outer area 39 of the abutment 26. The abutment 27 has a radial inner area 30 that has a spacing b relative to a radial inner area 40 of the abutment 26; the spacing b is greater than the spacing a. The areas 29, 30, 39, 40 extend across the entire circumference and are illustrated in FIG. 1, for the purpose of simplifying the illustration, above the axis of rotation 4 while the spacings a, b are shown below the axis of rotation 4. The spacings a and b are different because of the coil-shaped configuration of the abutment 26 across the circumference; however, at each abutment web there exists the difference between the spacings a and b, measured parallel to the axis of rotation 4. It can be provided that only in one area of the circumference a difference between the spacings a and b is present. The spacing b is advantageously greater by more than one half the winding height c than the spacing a. In the illustrated embodiment, the spacing b is approximately greater by one winding height C than the spacing a. As shown in FIG. 1, the cone shape of the abutment 27 of the output element tapers in a direction away from cable drum 9. The cone that is provided by the abutment 27 on the output element is positioned relative to the axis of rotation 4 at an angle $\alpha$ that is, for example, between 20 degrees and 70 degrees, in particular between 30 degrees and 60 degrees. In the illustrated embodiment, the angle $\alpha$ is approximately 50 degrees.

Figure 2:
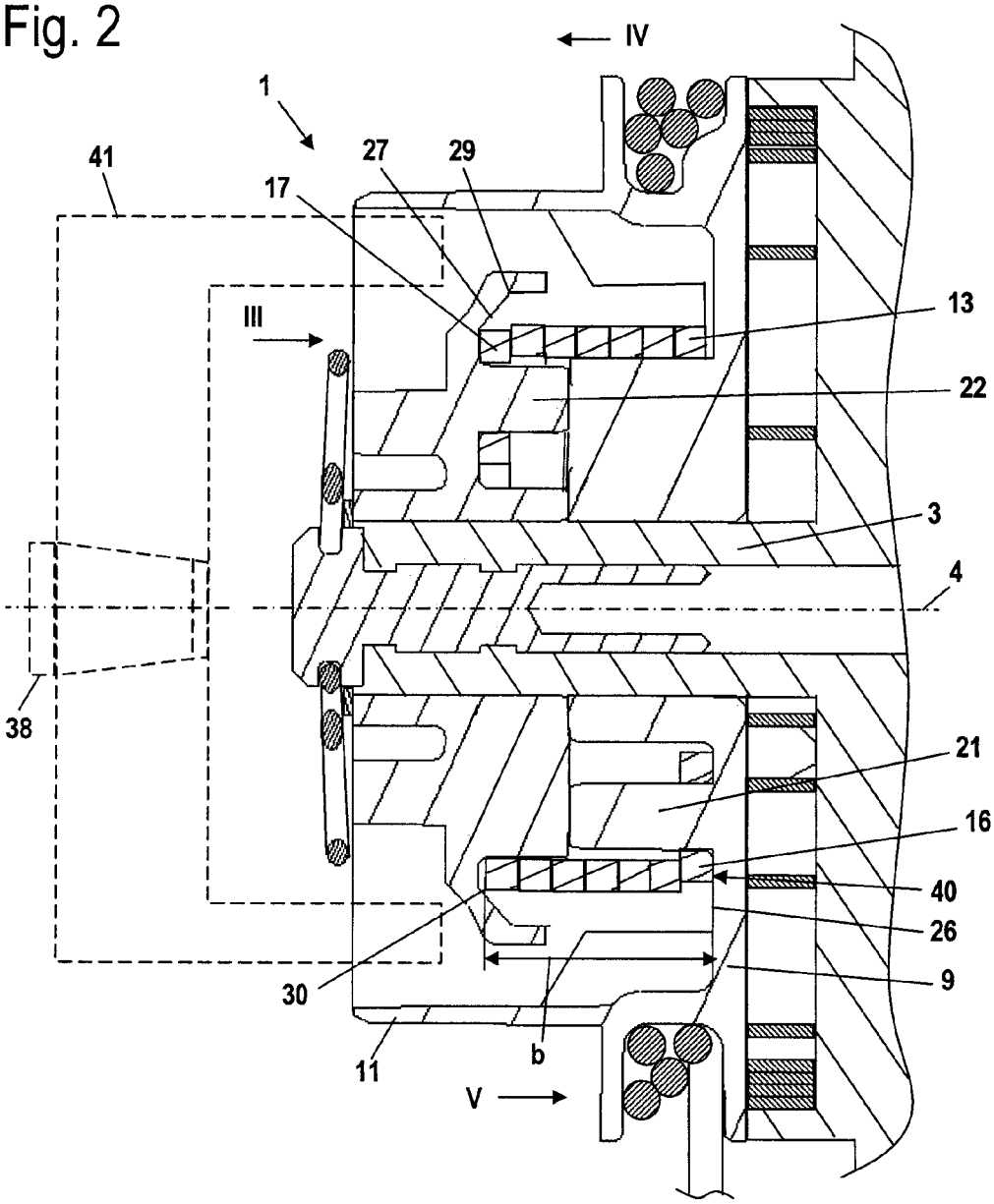
FIG. 2 shows the starter device of FIG. 1 in a second position.
Figure 3:
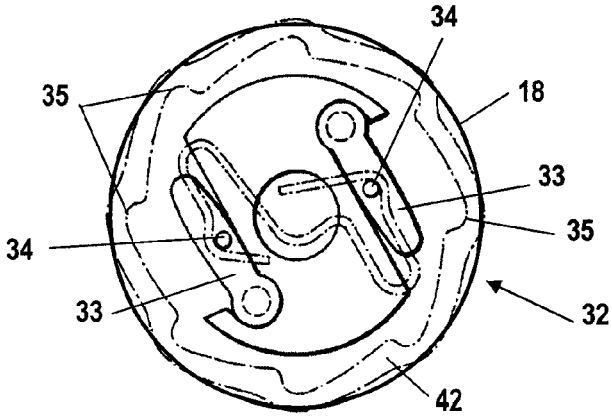
FIG. 3 is a detail plan view of the starter device in the direction of arrow III of FIG. 2.

FIG. 2 shows the starter device 1 in the actuated state. The follower 18 is coupled by means of a safety catch 32 illustrated in FIG. 3 to the crankshaft 38 of an internal combustion engine of a hand-held power tool. The safety catch 32 couples the starting device 1 upon actuation of the starter cable 14 to the crankshaft 38. On the crankshaft 38 a fan wheel 41 is fixedly mounted that has a rim 42 which projects into the receiving space that is surrounded by the rim 11 of the cable drum 9. On the follower 18 two pawls 33 are supported which are illustrated in FIG. 3. Each of the two pawls 33 has pins 34 projecting into the area of the safety bracket 25. When the follower 18 is rotated relative to the bearing shaft 3 and the securing bolt 23, the follower 18 performs together with the pawls 33 a relative movement relative to the securing bracket 25 that is clamped on the securing bolt 23. This relative movement has the effect that the pins 34 move within the contour defined by the safety bracket 25. This movement effects a pivoting of the pawls 33 radially outwardly. In FIG. 3, the rim 42 of the fan wheel 21 is illustrated in dash-dotted lines. The rim 42 has several locking recesses 35 where the pawls 33 will lock in their outwardly pivoted state. In this way, the follower 18 is fixedly connected to the crankshaft 38 in this rotational direction.

By means of the crankshaft that is connected to a piston of the internal combustion engine the follower 18 is first secured while the cable drum 9 rotates. In this way, the coil spring 13 is tensioned. This has the effect that the windings of the coil spring 13 with regard to their diameter will become smaller. At the same time, tensioning of the coil spring 13 causes an elongation of the coil spring 13. Upon tensioning the coil spring 13, the coil spring 13 glides along the abutment 27 from the radial outer area 29 to the radial inner area 30. Because the abutment 27 at the output element is not perpendicular to the axis of station 4 but is slanted relative to the axis of rotation 4, the spacing a, b between the two abutment 26 and 27 in any relative rotational position of the follower 18 and the cable drum 9 correspond to the length of the coil spring 13. The spacing a in the radial outer area 29 corresponds thus approximately to the axial length of the coil spring 13 in the relaxed state and the spacing b in the radially inner area 30 corresponds to the length of the coil spring 13 in the tensioned state. Additional means for compensating the axial length of the coil spring 13 are not required. In this way, a simple configuration of the starter device 1 is provided.

In the embodiment the winding height c matches approximately the height of the wire of the coil spring. The coil spring 13 is positioned in the axial direction approximately as a stack. The cross-section of the spring wire of the coil spring 13 is rectangular, in particular square, so that a high section modulus results. Because the coil spring 13 is approximately in a stacked configuration, a minimal axial length and minimal size results. Therefore, changes of the length of the coil spring 13 cannot be compensated by the coil spring 13 itself for example, by changing the spacing between the windings. A compensation of the axial length can be provided by the different spacings of the abutments 26 and 27 of the drive element and the output element in regard to the different radial spacings relative to the axis of rotation 4.

It can also be provided that the cross-section of the wire of the coil spring 13 is round. Also, other cross-sectional shapes can be expedient. It can be provided that the abutment 26 of the drive side as well as the abutment 27 of the output side are coil-shaped in order to achieve an excellent guiding action of the coil spring 13. Also, both abutments 26 and 27 can be conical wherein the pitch of the cone is to be matched appropriately. It can be provided that the conical abutment is designed as a continuous conical surface but the conical surface can also be provided in the form of individual webs that are slanted relative to the axis of rotation 4.

The specification incorporates by reference the entire disclosure of German priority document 10 2007 008 327.2 having a filing date of Feb. 16, 2007.

While specific embodiments of the invention have been shown and described in detail to illustrate the inventive principles, it will be understood that the invention may be embodied otherwise without departing from such principles.

What is claimed is:

1. A starter device for an internal combustion engine, the starter device comprising:

a drive element and an output element, wherein the drive element comprises a device for rotatingly driving the starter device and wherein the output element is supported so as to be rotatable about an axis of rotation and comprises coupling means for releasably coupling the starter device to a crankshaft of an internal combustion engine;

a coil spring arranged in operative connection between the drive element and the output element, wherein the coil spring is arranged in an axial direction between a first abutment at the drive element and a second abutment at the output element and wherein the coil spring has a first end resting against the first abutment and a second end resting against the second abutment;

wherein the first and second abutments have a first spacing relative to one another at least at one circumferential location in a first area of the first and second abutments and have a second spacing relative to one another in a second area of the first and second abutments, wherein the first and second spacings are measured parallel to the axis of rotation, respectively, wherein the first spacing is smaller than the second spacing, and wherein the first area is located radially outside of the second areas;

wherein the coil spring has a relaxed state and a tensioned state, wherein the coil spring in the tensioned state has a smaller diameter than in the relaxed state; and wherein the first and second ends of the coil spring in the relaxed state rest in said first area of the first and second abutments and in the tensioned state rest in said second area of the first and second abutments.

2. The starter device according to claim 1, wherein a difference between the first spacing and the second spacing is greater than one half of a winding height of the coil spring.

3. The starter device according to claim 2, wherein said difference matches approximately one winding height of the coil spring.

4. The starter device according to claim 1, wherein at least one of the first and second abutments is conical.

5. The starter device according to claim 1, wherein the first abutment is slanted relative to the axis of rotation in a radial direction and wherein the second abutment extends flat in the radial direction relative to the axis of rotation.

6. The starter device according to claim 1, wherein at least one of the first and second abutments is coil-shaped in a circumferential direction of the first and second abutments and has a pitch that matches approximately a pitch of the coil spring.

7. The starter device according to claim 1, wherein at least one of the first and second abutments is comprised of abutment webs extending in a radial direction relative to the axis of rotation.

8. The starter device according to claim 1, wherein the drive element is a cable drum and the device for rotatingly driving the starter element is a starter cable wound onto the cable drum and provided with a starter handle.

9. The starter device according to claim 8, wherein a restoring spring is arranged on the cable drum.

10. The starter device according to claim 8, wherein the coil spring has a first end connected to the cable drum.

11. The starter device according to claim 1, comprising a guide arranged inside the coil spring for guiding an inner circumference of the coil spring.

12. The starter device according to claim 11, wherein the guide is comprised of several guide webs extending parallel to the axis of rotation.

13. The starter device according to claim 12, wherein the drive element and the output element each have guide webs.

14. The starter device according to claim 1, wherein the output element comprises a follower and wherein the second abutment is arranged on the follower.

15. The starter device according to claim 1, wherein the coupling element is a safety catch comprising at least one pawl that in a coupled state interacts with at least one locking recess.

16. The starter device according to claim 15, wherein the output element comprises a follower and the at least one pawl is arranged on the follower.

17. The starter device according to claim 1, wherein the coil spring is comprised of a wire having a rectangular cross-section.

* * * * *